US008685192B2

(12) United States Patent
Schulte

(10) Patent No.: US 8,685,192 B2
(45) Date of Patent: Apr. 1, 2014

(54) METHOD OF, AND ARRANGEMENT FOR, PRODUCING A FIXING MEANS

(75) Inventor: Axel Schulte, Tübingen (DE)

(73) Assignee: Gottlieb Binder GmbH & Co. KG, Holzgerlingen (DE)

( * ) Notice: Subject to any disclaimer, the term of this patent is extended or adjusted under 35 U.S.C. 154(b) by 1102 days.

(21) Appl. No.: 11/988,633

(22) PCT Filed: Jul. 11, 2006

(86) PCT No.: PCT/EP2006/006739

§ 371 (c)(1),
(2), (4) Date: Jan. 11, 2008

(87) PCT Pub. No.: WO2007/036252

PCT Pub. Date: Apr. 5, 2007

(65) Prior Publication Data

US 2009/0077776 A1 Mar. 26, 2009

(30) Foreign Application Priority Data

Sep. 29, 2005 (DE) ..... 10 2005 048 215

(51) Int. Cl.
*B29C 65/00* (2006.01)
*A44B 18/00* (2006.01)

(52) U.S. Cl.
USPC ..... 156/242; 156/293; 156/303.1; 24/447; 24/448

(58) Field of Classification Search
USPC ..... 24/447, 448, 444, 443; 156/242, 245, 156/293, 303.1
See application file for complete search history.

(56) References Cited

U.S. PATENT DOCUMENTS

| | | | | | |
|---|---|---|---|---|---|
| 1,653,052 | A | * | 12/1927 | Litchfield | 227/91 |
| 3,527,629 | A | * | 9/1970 | Wylde | 156/72 |
| 3,686,718 | A | * | 8/1972 | Brumlik | 24/447 |
| 4,290,174 | A | | 9/1981 | Kalleberg | |
| 5,040,275 | A | | 8/1991 | Eckhardt et al. | |
| 5,090,095 | A | * | 2/1992 | Lightfoot | 24/306 |
| 5,384,939 | A | * | 1/1995 | Weber | 24/306 |

FOREIGN PATENT DOCUMENTS

| | | |
|---|---|---|
| DE | 1 500 960 | 7/1969 |
| DE | 2 059 881 | 6/1971 |
| DE | 2 005 353 | 8/1971 |
| EP | 0 037 652 | 10/1981 |
| EP | 0 461 777 | 12/1991 |
| EP | 1 047 539 | 11/2000 |
| WO | WO 97/31549 | 9/1997 |
| WO | WO 98/46417 | 10/1998 |

* cited by examiner

*Primary Examiner* — William Bell
(74) *Attorney, Agent, or Firm* — Roylance, Abrams, Berdo & Goodman LLP

(57) ABSTRACT

A method of and an arrangement for producing a fixing part, for example in the form of a touch-and-close fastener part, includes the formation of a carrier structure (10) provided with stem-like fixing elements (12) connected to one another at least in pairs via intermediate elements (14) to form cramp-like, in particular U-shaped, fixing parts (16). The stem-like fixing elements (12) engage through the carrier structure (10) and project beyond it. Each intermediate element (14) extending between these fixing elements (12) is arranged on the carrier structure (10). The respective fixing part (16) is introduced as a whole into the carrier structure (10) which, for this purpose, is designed in the form of a cramp-like, in particular U-shaped, molding prior to introduction.

13 Claims, 3 Drawing Sheets

METHOD OF, AND ARRANGEMENT FOR, PRODUCING A FIXING MEANS

CROSS-REFERENCE TO RELATED APPLICATIONS

This application is a National Stage entry of International Patent Application No. PCT/EP2006/00006739, filed Jul. 11, 2006, which claims priority to German Patent Application No. DE 102005048215, filed Sep. 29, 2005.

FIELD OF THE INVENTION

The invention relates to a method of and arrangement for producing a fixing means, for example, in the form of a touch-and-close fastener part. The method and arrangement include formation of a support structure provided with stem-like fixing elements connected to one another at least in pairs by intermediate elements with the formation of cramp-shaped, in particular U-shaped, fixing parts. The stem-like fixing elements extend through the support structure and project over it. The intermediate elements extending between these fixing elements are located on the support structure.

BACKGROUND OF THE INVENTION

EP 1 047 539 B1 discloses a molding process for producing fastening articles in addition to a process for implementing the process. In the known solution, in a first step, a premolding element as the support structure is formed in the mold cavity of an injection molding machine. The cavity is defined by the first and second parts of a mold. In this molding process, on one side of the support structure, a plurality of stem-like fixing elements are formed. At least one connecting means, with which the premolding element completed later can be fixed on other components, is molded onto the opposite back side of the support structure.

In another production step, the first part of the mold is then removed to expose an arrangement of stem-like fixing elements as so-called mold elements, while in other respects the premolding element as the support structure remains in the second part of the mold. In a subsequent molding process, permanent deformation of the stem-like fixing element is induced, for example using heat and pressure to generate head-like fastener elements in the manner of a mushroom fastener on the free ends of the stem-like fixing elements. The number of fixing elements to be mounted on the support structure in the known solution encounters its limits where the mold tool with its mold cavities to be provided for the stem-like fixing elements has its corresponding wall boundaries.

U.S. Pat. No. 4,290,174 discloses a generic process in addition to a device for producing a fixing means. In the production process disclosed in FIG. 6 of that U.S. patent, two belt-like support structures are unwound opposite from storage rolls and delivered to a conveyor machine with two opposing drivable support belts, with a top strand and a bottom strand. Via a thread supply means with a plurality of channels, a corresponding plurality of monofilament threads are supplied to the conveyor and transport means and are connected in alternation by two tacking means of the threads to the film-like heated support structure, in this respect by the monofilament threads in alternation being pressed into the pertinent strip material extending between the two support structure-film lengths.

Within the conveyor and transport means oppositely along the upper and lower strand, the lengths of film are then guided as the support structure. The lengths of film have the monofilament threads in place between themselves and are held on one another in this way. After running through the conveyor and transport means, a longitudinal cutting means is used to cut the respective monofilament threads braced between the support structures approximately in the middle so that two lengths of the support structure separated from one another are present and can be taken up onto removal rolls for further processing. The respective strip-like support structure is then characterized in that cramp-shaped, in particular U-shaped, fixing parts are fastened in the structure on the peripheral side with surrounding material portions. Only the stem-like fixing elements then protrude from the support structure which otherwise, after the cutting process and before take-up, are brought into the interlocking head shape by a singeing means. The alternating squeezing or molding of the monofilament threads at the entry of the conveyor and transport means, however, leads to problems of process reliability. On the whole, this production process may then be difficult to manage.

The known fixing means are used in conjunction with another fixing part provided, for example, on its top with a loop-shaped structure, especially to form a detachable touch-and-close fastener by the hook elements extending under the head parts of the stem-like fixing elements to enable a plurality of opening and closing processes. These fixing elements are generally used in the clothing and in the diaper industry. They are increasingly also being used in technical applications, whether in the area of cable connectors, or in the automotive or other vehicle industry to be able to fasten the corresponding components to vehicle structures.

SUMMARY OF THE INVENTION

An object of the invention is to provide a method and a device for producing a fixing means such that high process reliability and high production quality for the product is achieved, and a high level of production speed is ensured to reduce production costs.

This object is basically achieved by a method for producing a fixing means where the respective fixing part as a whole is introduced into the support structure made cramp-shaped, in particular U-shaped, for this purpose as a molded part before introduction. A type of shooting means with very high production speeds joins the respective fixing part to the support structure. In spite of the high production speeds which are surprising in this respect, it is surprising for one with average skill in the art in the field of production of touch-and-close fastener parts that a very high product quality with a negligible scrap rate is achieved.

If the support structure to be provided with the cramp-shaped, in particular U-shaped, fixing parts is still soft, that is at least in the partially plasticized or doughy state, it is possible to shoot the fixing parts into the closed base structure of the support, preferably of the corresponding plastic material, to achieve virtually one-piece fixing. Preferably, an inherently strong support structure for passage of the stem-like fixing elements is provided with recesses. To hold the respective intermediate element, at least partially transverse recesses extend between the longitudinal recesses and discharge on the support structure into the open. In this configuration, the support structure is then already completely extruded or injected with its recesses. The fixing parts are then placed as a finished component into the support structure in the manner of a shot. In this respect, the fixing parts can be introduced still partially plasticized into the support structure and ultimately cured only there.

In this process, the support structure on its front side then is provided with a plurality of fixing elements in the manner of a "porcupine structure." The product produced in this way can be used as an intermediate product for possible additional production processes. Preferably, under heat or pressure the free stem ends of each fixing element are provided with a head or hook structure to produce a mushroom-shaped or hook-shaped fastener element which, with the corresponding loop material or nonwoven of a corresponding fastener element, forms a touch-and-close fastener part. In the implementation of a mushroom-like structure for the fixing elements, it is then also possible to allow them to interact with a corresponding mushroom fastener material in which the mushrooms of one fastener part detachably engage the intermediate spaces of the mushroom material of the other fastener part for closing the fastener.

This object is also basically achieved by a device according to the invention for implementing the indicated process. The device is provided with a feed part which supplies the cramp-shaped, in particular U-shaped, fixing parts as a whole to the support plate in a forward-pointed supply position and can be provided with another fixing part in a rear magazining position. Similarly to a shooting apparatus, the cramp-shaped fixing part is then moved out of the magazining position into the supply position. The fixing part is shot into the support structure at each respectively provided position.

Other objects, advantages and salient features of the present invention will become apparent from the following detailed description, which, taken in conjunction with the annexed drawings, discloses a preferred embodiment of the present invention.

BRIEF DESCRIPTION OF THE DRAWINGS

Referring to the drawings which form a part of this disclosure and which are schematic and not to scale.

DETAILED DESCRIPTION OF THE INVENTION

Figure 3:
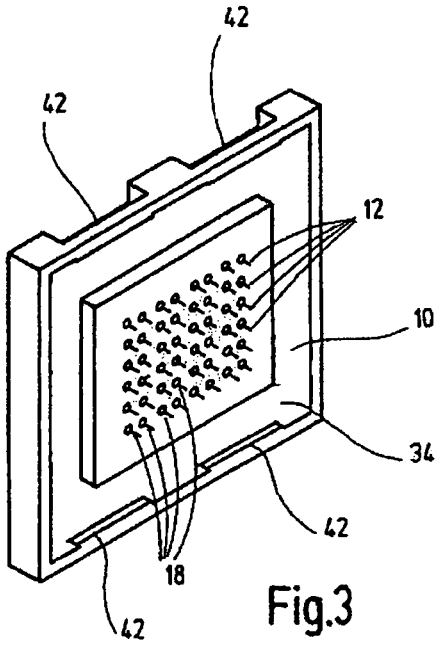
FIG. 3 is a perspective front view of a plate-like support structure of the device of FIG. 1 with the stem-like fixing elements.
Figure 5:
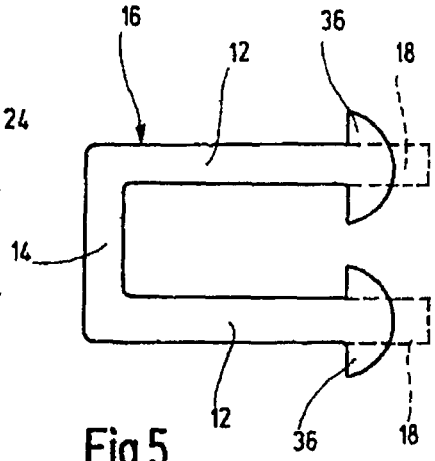
FIG. 5 is a side elevational view of a U-shaped fixing element for the device of FIG. 1.

The process according to the invention is used to produce a fixing means as is shown not yet completed in FIG. 3 by way of example. This fixing means is made, for example, as a touch-and-close fastener part and can be a component of a touch-and-close fastener, as has become known under the trademark "Kletten" [hook and loop fastener]. The process according to the invention presupposes first of all the formation of a support structure 10 provided with stem-like fixing elements 12 (cf. FIGS. 1, 3 and 5). As shown in particular by FIG. 5, these stem-like fixing elements 12 are connected integrally to one another in pairs on their base sides by transversely running intermediate elements 14. In this way a cramp-shaped, in particular U-shaped, fixing part 16 as a whole is formed. A fixing part 16 could also have more than two stem-like fixing elements 12 in the form of a multi-pronged body in which the other fixing element could be connected transversely to the figure plane of FIG. 5 to the intermediate element 14, for example to another intermediate element emerging from the plane of the drawing. However, the solution according to the invention will be described below using the two-pronged structure as shown in FIG. 5.

Figure 1:
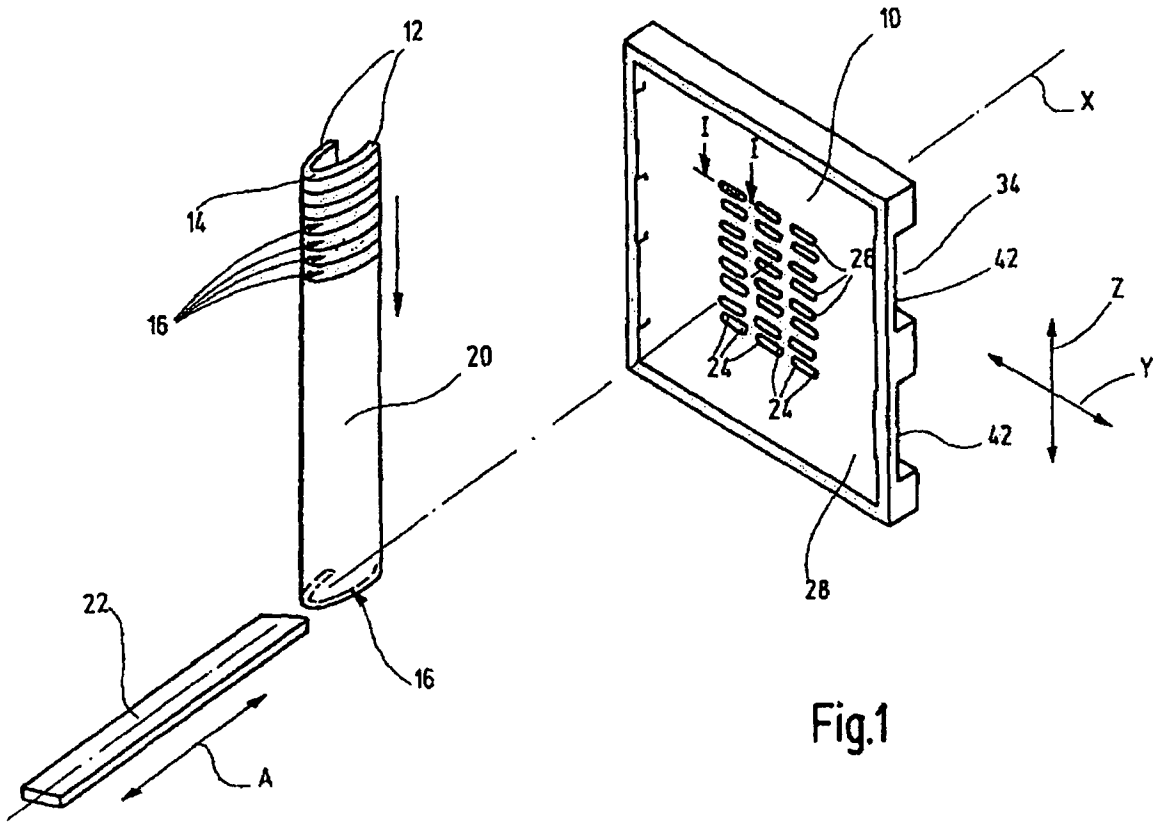
FIG. 1 is a prospective view of the basic structure of a production device for implementing a method according to an exemplary embodiment of the invention.

The respective fixing part 16 can be made rather U-shaped as shown in FIG. 1, but also V-shaped. A configuration as shown in FIG. 5 is preferred in which the two projecting stem-like fixing elements 12 undergo transitions at right angles into the intermediate element 14. In the initial state of product manufacture, the free ends 18 of the fixing elements 12 are not yet reshaped so that the fixing elements 12 overall form cylindrical extensions. As FIG. 1 illustrates, these fixing parts 16 are magazined on top of one another and are guided in a magazine position 20. For the sake of a simpler representation, the stack arrangement is shown in FIG. 1. From the lower magazine position 20, a cramp-shaped, in particular U-shaped, fixing part 16 can be removed by a tongue-shaped feed part 22 and fed onto the support plate 10 along the axial direction X into a supply position (not illustrated). With the feed part 22 set back into the magazine position 20, as shown in FIG. 1, a magazined fixing part 16 can then descend until it reaches the position shown in FIG. 1 in which again supply to the support plate 10 is possible. In this way, the feed part 22 moves forward and backward for a production sequence as shown by the arrow A in FIG. 1.

Figure 4:
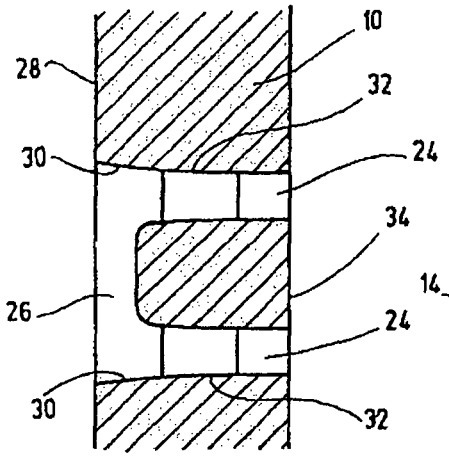
FIG. 4 is a partial top plan view in section taken along line I-I in FIG. 1 for one recess of the support structure.

The plate-shaped support structure 10 for penetration of the stem-like fixing elements 12 is provided with preformed longitudinal recesses 24 in a double-hole arrangement (see cross section as shown in FIG. 4) between which a preformed transverse depression or recess 26 extends between the longitudinal recesses of respective pairs to hold the intermediate element 14 of the fixing part 16 and discharges into the open on the free rear of the support structure 10. As is especially seen in FIG. 4, this transverse recess 26 stands vertically on the two recesses 24 positioned a certain distance from each other. To achieve good introduction of the cramp-like fixing parts 16 originating from the rear 28 of the support structure 10, the transverse recess 26 widens by means of conically running boundary walls 30, which, for the purpose of guidance, discharges less steeply into a conical intermediate wall region 32 of the longitudinal recesses 24. Towards its free end, each recess 24 discharges on the front 34 of the support structure 10 and has a cylindrical, stabilizing shoulder for the free end region of the two fixing elements 12. In this way, with the recesses 24, 26, "threading" of the fixing elements 12 into the support structure 10 is achieved. After completed fixing, the fixing part 16 is reliably pre-positioned on the support structure 10.

So that the supply means (feed part 22) can provide all the recesses 24, 26 present in the support structure 10 with assignable cramp-like fixing parts 16, control of the support structure 10 is necessary such that it can be moved in directions perpendicular to one another according to the double arrows Y and Z achieve supply via line X to the respective opening in the support structure 10. Alternatively, with the plate at rest, the supply means can move, or the support structure and the supply means can be secured analogously for outfitting the support structure 10 with fixing parts 16. The supply means shown in FIG. 1 with a feed part 22 can, in a shot-like sequence, provide the support structure 10 with fixing parts 16 with high target precision so that not only can a very rapid production process be implemented, but also process faults and scrap rates are reduced. The described production process therefore can be operated very economically. Also several shooting apparatus (not shown) can be used for one or more support structures 10 in juxtaposition.

Figure 2:
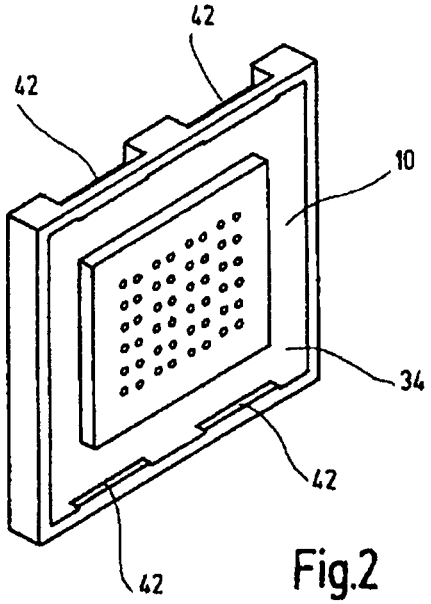
FIG. 2 is a perspective front view of a plate-like support structure of the device of FIG. 1 without the stem-like fixing elements.

When all the fixing parts 16 have been introduced into the support plate as the support structure 10, the free stem ends 18 as shown in FIG. 3 project above the front side 34 of the support structure 10. This front side can be provided as shown in FIGS. 2 and 3 with a rectangular, in particular square placement field. Other geometrical configurations are also conceivable here. In particular, the support structure 10 can be made as a film-like belt or the like. If the stem-like fixing elements shown in FIG. 3 are to be provided on the end side with an interlocking element, such as, for example, an interlocking mushroom 36 (cf. FIG. 5), it is sufficient to heat or singe the free ends 18 of the stems 12. As a result of the surface tension of the plastic material, they then form a head structure analogous to the interlocking mushrooms 36 as shown in FIG. 5. In addition or alternatively, there can also be an independent molding means (not shown) inducing shaping for the free ends 18 of the stem 12. In addition to the mushroom-like structures, formation of conventional fastener hooks or the like would then be possible. Since these production process steps are known, for example, by FIGS. 3 and 4 of EP 1 047 539 B1 in addition to the respective text sites, they will not be further described here. Basically, however, it is also possible to deliver the fastener means as shown in FIG. 3 without the interlocking elements as an intermediate product to the further processing industry for possible further use.

Figure 6:
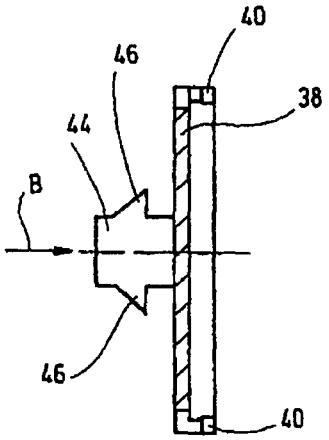
FIG. 6 is a side elevational view in section taken along line II-II in FIG. 7, with the connecting means attached to the rear.
Figure 7:
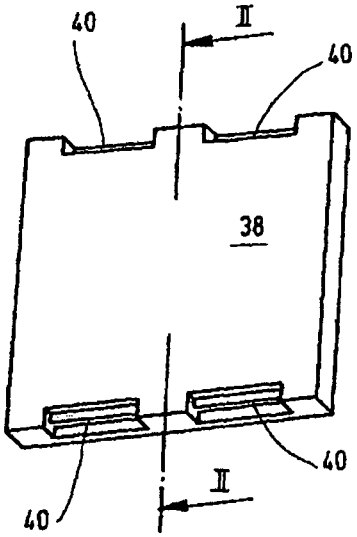
FIG. 7 is a rear perspective of a closing plate for the device of FIG. 1, viewed in direction B of FIG. 6, but without the pin-like connecting means.

So that the fixing parts 16 do not again unintentionally leave the support structure 10 with its recesses 24, 26, for example, by falling out, they are cemented in the openings of the support plate 10 by a suitable adhesive material. As shown in FIGS. 6 and 7, a termination plate 38 can clip them via clip connection means 40 with clip connections 42 attached on the edge side opposite in the wall region of the support structure 10 (cf. FIGS. 2 and 3). Preferably, the fixing parts 16 are cemented both in the support structure 10 and the closing plate 38 to be seated, in particular to form a clean termination to the exterior.

This closing support plate 38, as is shown especially in FIG. 6, can be provided on its rear with at least one connecting means or connector 44 enabling locking of the combination of the closing plate 38 with the support structure 10 on third parts, for example, on vehicle parts, with at least two opposite catch parts 46. In this way, the fixing means can be applied in the manner of an island to the roof area of a motor vehicle on which the head liner could then be reliably fixed stationary by the corresponding fixing elements, for example, in the form of loops—attached to the head liner—with the formation of a touch-and-close fastener part.

It is within the scope of the invention to make the support structure 10 partially plasticized without recesses 24, 26 to then shoot the fixing parts 16 permanently into the structure of the support plate in the manner of shot cramps. Furthermore, double-acting touch-and-close fastener parts can be produced if, as is not shown, the fixing parts 16 are shot from the two sides into recesses so that they can project with their free end regions 18 both on the front side 34 and on the back side 28.

Instead of the device as shown in FIG. 1, the respective fixing part 16 can be obtained from a plastic monofilament element supplied in the form of a line or thread from a storage means (not shown) of a shaping zone to the supply means. The supply means then first reshapes the monofilament wire into the cramp-shaped fixing part 16 in order then in the next step to enable introduction of the fixing part into the support structure 10. In this configuration as well very high production rates can be achieved. When a support structure 10 is equipped with the fixing parts 16, it leaves the feed device and a new support plate as the support structure 10 is supplied to the feed with the fixing parts 16. In this respect, the use of a magazining means is then unnecessary.

With the device according to the invention and the respective process, preferably thermoplastic materials can be easily processed. The plate-like support structure 10 preferably is formed of a material which is easily subjected to injection-molding. A metal mold blank with cramp-like fixing parts 16 of easily processed plastic, such as for example polypropylene or polyamide, or of an easily moldable metal material, can also be provided.

The invention claimed is:

1. A method for producing a fixing means, comprising the steps of providing a support structure having preformed longitudinal recesses arranged in pairs with the longitudinal recesses of each pair being connected by a preformed transverse recess opening on a surface of the support structure;

molding stem-shaped fixing elements arranged in pairs with the fixing elements of each pair being connected by an intermediate element to form U-shaped molded fixing parts; and inserting the molded fixing parts into the support structure with the fixing elements being received in the longitudinal recesses and the intermediate elements being received in the transverse recesses such that the fixing elements extend through the support structure and project from the support structure with the intermediate elements being located on the support structure by shooting the fixing parts with a shooter to join the fixing parts and the support structure.

2. A method according to claim 1 wherein at least partially free ends of the fixing elements are heat treated to form one of head-shaped fastener elements and hook-shaped fastener elements.

3. A method according to claim 1 wherein at least partially free ends of the fixing elements are mechanically reshaped to form one of head-shaped fastener elements and hook-shaped fastener elements.

4. A method according to claim 1 wherein the molded fixing parts are at least one of melted, cemented and clipped to support structure.

5. A method according to claim 1 wherein the support structure is plate-shaped and is coupled to a closing plate.

6. A method according to claim 5 wherein the closing plate has at least one connector on a side thereof facing away from the support structure.

7. A method according to claim 1 wherein the support structure is made of a thermoplastic material formed by injection molding; and the fixing parts are formed from a plastic monofilament.

8. A method according to claim 7 wherein the monofilament is a polyamide or polypropylene filament.

9. A method according to claim 1 wherein the fixing parts are in a partially plasticized or doughy state when introduced into the support structure.

10. A method according to claim 9 wherein the fixing parts are cured in the support structure.

11. A method according to claim 1 wherein the fixing parts are shot by a feed part from a magazine of fixing parts.

12. A method for producing a fixing means, comprising the steps of providing a support structure;

molding stem-shaped fixing elements arranged in pairs with the fixing elements of each pair being connected by an intermediate element to form U-shaped molded fixing parts; and inserting the molded fixing parts in a partially plasticized or doughy state into the support structure such that the fixing elements extend through the support structure and project from the support structure with the intermediate elements being located on the support structure by shooting the fixing parts with a shooter to join the fixing parts and the support structure.

13. A method according to claim 12 wherein the fixing parts are cured in the support structure.

* * * * *